US008305168B2

(12) United States Patent
Cotič et al.

(10) Patent No.: US 8,305,168 B2
(45) Date of Patent: Nov. 6, 2012

(54) FORCED RETURN SOLENOID

(75) Inventors: Ivan Cotič, Dornberk (SI); Tomaž Bratuš, Vipava (SI); Sebastjan Kobal, Šempas (SI)

(73) Assignee: Iskra Avtoelektrika d.d., Sempeter pri Gorici (SI)

( * ) Notice: Subject to any disclaimer, the term of this patent is extended or adjusted under 35 U.S.C. 154(b) by 219 days.

(21) Appl. No.: 12/726,803

(22) Filed: Mar. 18, 2010

(65) Prior Publication Data

US 2011/0227676 A1 Sep. 22, 2011

(51) Int. Cl.
*H01H 67/02* (2006.01)

(52) U.S. Cl. ..... 335/126; 385/131; 385/255; 385/256; 385/238; 385/279

(58) Field of Classification Search ..... 335/126, 335/238, 131, 255–256, 279
See application file for complete search history.

(56) References Cited

U.S. PATENT DOCUMENTS

| | | | | |
|---|---|---|---|---|
| 4,755,781 | A * | 7/1988 | Bogner | 335/131 |
| 4,825,180 | A * | 4/1989 | Miyaji | 335/131 |
| 5,394,128 | A * | 2/1995 | Perreira et al. | 335/126 |
| 5,894,256 | A * | 4/1999 | Kobayashi et al. | 335/126 |
| 6,552,638 | B2 | 4/2003 | Rhodes | |
| 7,157,996 | B2 * | 1/2007 | Enomoto et al. | 335/132 |
| 7,639,108 | B2 * | 12/2009 | Miyake | 335/126 |
| 2004/0032309 | A1 * | 2/2004 | Kajino et al. | 335/126 |
| 2006/0109070 | A1 * | 5/2006 | Hirabayashi et al. | 335/126 |

FOREIGN PATENT DOCUMENTS

SI 20833 A 8/2002

* cited by examiner

*Primary Examiner* — Mohamad Musleh
(74) *Attorney, Agent, or Firm* — Reinhart Boerner Van Deuren P.C.

(57) ABSTRACT

A forced return solenoid that includes an electrical winding configured to create an electromagnetic field when electrical current flows through the winding, an electrical terminal configured to be connected to a source of electrical energy, and a moveable contact plate configured to be moved into contact with the electrical terminal. Embodiment of the forced return solenoid include a plunger configured to move axially in response to the electromagnetic field generated by the electrical winding. Movement of the plunger in one direction causes the moveable contact plate to connect with the electrical terminal. Movement of the plunger in the opposite direction causes an impact intended to break the connection between the moveable contact plate and the electrical terminal. Embodiments of the forced return solenoid further include a return spring configured to move the plunger in the second direction, wherein the impact means comprises a removable snap ring affixed to the plunger.

18 Claims, 5 Drawing Sheets

FORCED RETURN SOLENOID

FIELD OF THE INVENTION

This invention generally relates to electrical components for a vehicle, and, more specifically, to starter motors used in the ignition system of a vehicle.

BACKGROUND OF THE INVENTION

Generally, internal combustion engines require the pistons to be moving before ignition can commence. Typically, this means that the engine must be set in motion by some external force before the engine can power itself via combustion of fuel. Most vehicles employ an electric starter to set the engine in motion, thereby allowing ignition to take place.

An electric starter motor is often used to crank internal combustion engines prior to ignition. Typically, the electric starter consists of three main assemblies: 1) the solenoid switch that ensures axial movement of the plunger within the electrical coils of the switch, and, therefore, the subsequent engagement and disengagement of a pinion into a ring gear through an engagement lever, and also establishing and breaking of the electrical contacts, which enables transmission of electric energy from the battery to the electric motor part of the starter; 2) a DC electric motor, which transform electrical power into the mechanical rotating power that is required to crank the internal combustion engine; and 3) a mechanical transmitter which consists of a reduction gear, clutch, and a pinion, and is used to transmit the rotating power from the electrical motor to the internal combustion engine.

A typical starter for a vehicle may include a DC electric motor with a solenoid switch that is activated upon the closing of an ignition switch. When a driver turns an ignition key or presses a start button that closes the ignition switch, an electrical current is supplied from the battery to the solenoid windings. Typically, this causes a drive pinion on the starter driveshaft to mesh with a ring gear on the flywheel of the engine. The solenoid assembly, which has an electrical winding, electrical terminals, and high-current contacts, acts to close the high-current contacts for the starter's DC electric motor after the drive pinion engages the ring gear, thus connecting the battery to the electric motor and causing the electric motor to turn. The meshing of the pinion to the flywheel ring gear means that the rotating DC electric motor causes the vehicle engine to rotate as well. Generally, after the engine starts, the ignition switch opens, and a return spring in the solenoid assembly pulls the pinion gear away from the ring gear, and the starter's electric motor stops.

Occasionally, the switching of the starter motor current on and off results in a partial welding or fusing of the high-current contacts and the electrical terminals due to electrical arcing between the high-current contacts and the contact plate. Typically, the solenoid assembly return spring has enough force to mechanically break this partial fusing of contact and terminal. However, occasionally, the return spring force is insufficient, and the solenoid's high-current contacts can become welded in the closed position to a contact plate. This causes the starter's DC electric motor to maintain its connection to the vehicle battery even after the engine is running, and the starter will remain energized after the vehicle operator has released the ignition switch. Consequently, the starter motor will continue to run even after the vehicle engine is running on its own and the pinion has disengaged from the ring gear. As a result of the welded contact plate and terminals, it is possible that the starter motor could continue to run after the engine is turned off. In this case, the continuous usage of electrical energy by the starter motor may cause the battery's charge to be depleted prematurely. In any case, continuous operation of the starter motor caused by welded contact plate and terminals, will likely result in the overheating and premature failure of the starter motor, leading to increased maintenance costs for the vehicle owner and a potential for premature replacement of the affected components.

It would therefore be desirable to have a solenoid assembly with a mechanism for reducing the likelihood of high-current contact plate becoming welded to the electrical terminals. Embodiments of the invention provide such a solenoid assembly. These and other advantages of the invention, as well as additional inventive features, will be apparent from the description of the invention provided herein.

BRIEF SUMMARY OF THE INVENTION

In one aspect, embodiments of the invention provide a forced return solenoid that includes an electrical winding configured to create an electromagnetic field when electrical current flows through the winding, an electrical terminal configured to be connected to a source of electrical energy, and a moveable contact plate configured to be moved into contact with the electrical terminal. Embodiments of the forced return solenoid include a plunger configured to move axially in response to the electromagnetic field generated by the electrical winding. Movement of the plunger in one direction causes the moveable contact plate to connect with the electrical terminal. Movement of the plunger in the opposite direction causes an impact intended to break the connection between the moveable contact plate and the electrical terminal. Some embodiments of the forced return solenoid further include a return spring configured to move the plunger in the second direction, wherein the plunger impacts the moveable contact via a removable snap ring affixed to the plunger.

In another aspect, embodiments of the invention provide a method of operating a solenoid assembly used in a vehicle starting system. In an embodiment of the invention, this method includes the steps of mechanically biasing a moveable contact plate away from an electrical terminal such that the moveable contact plate and electrical terminal are physically separated. In this embodiment, the method further includes and mechanically biasing a moveable plunger away from the moveable contact plate such that the moveable plunger and the moveable contact plate are physically separated. Some embodiments of the method further include the steps of generating an electromagnetic field configured to overcome the bias on the moveable contact plate, and to overcome the bias on the moveable plunger in order to bring the moveable contact plate into contact with the electrical terminal, and attaching a removable snap ring to the moveable plunger. In an embodiment of the invention, the removable snap ring is configured to transfer kinetic energy from the moveable plunger to the moveable contact plate.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1A:
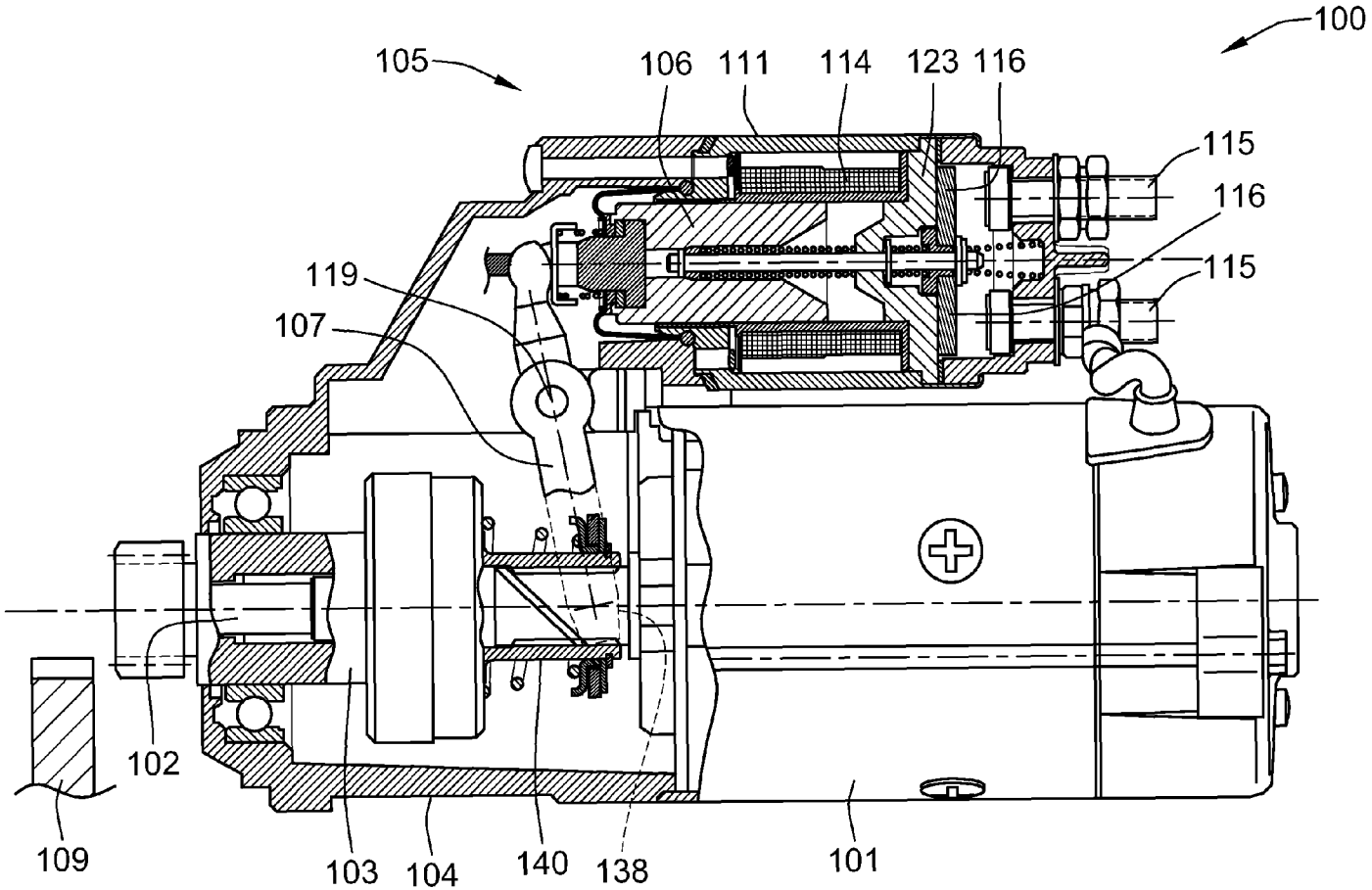
FIGS. 1A and 1B are cross-sectional views of a starter system incorporating a forced return solenoid assembly, constructed in accordance with an embodiment of the invention.
Figure 1B:
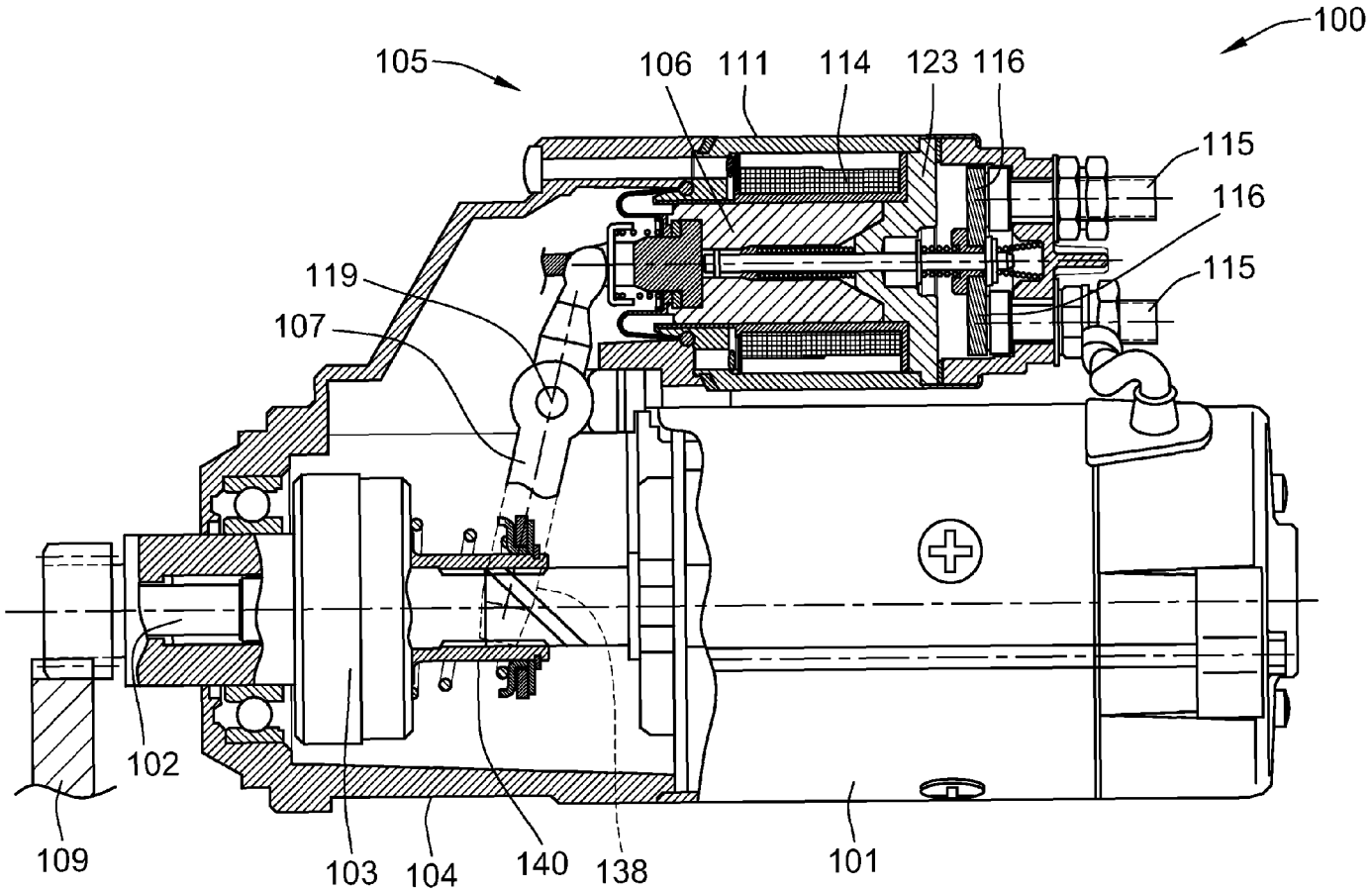

FIGS. 1A and 1B illustrate a cross-sectional view of a starter system 100 incorporating a forced return solenoid assembly 105, constructed in accordance with an embodiment of the invention. In operation, starter motor system 100 works to start the internal combustion engine (not shown), of a vehicle for example, using a DC electric motor 101 that is connected through a reduction gear (not shown) with gear shaft 102. In this embodiment, the gear shaft 102 includes a slipping clutch and pinion 103. The DC motor 101 is mounted on a front drive end bracket 104 on which is mounted to the forced return solenoid assembly 105. A plunger 106 is configured to move axially within a housing 111 of the forced return solenoid assembly 105. The axial movement of the plunger is 106 is transferred to the slipping clutch and pinion 103 through an engagement lever 107. A central portion of the engagement lever 107 is coupled to a pin 119, such that the engagement lever 107 is configured to rotate around the pin 119. Movement of the plunger 106 in one direction causes movement of the slipping clutch and pinion 103, via the engagement lever 107, in the opposite direction. For example, movement of the plunger 106 to the left causes the engagement lever 107 to move the slipping clutch and pinion 103 to the right. Conversely, movement of the plunger 106 to the right causes the engagement lever 107 to move the slipping clutch and pinion 103 to the left towards the engine ring gear 109.

In an embodiment of the invention, the operator triggers the command to crank the internal combustion engine using an ignition key. In this way, power is supplied to electrical terminal 115 when the driver turns the ignition key. The current runs to the pull-in and hold-in winding 114 of the forced return solenoid assembly 105, which results in the generation of an electromagnetic field within the pull-in and hold-in winding 114.

Figure 2:
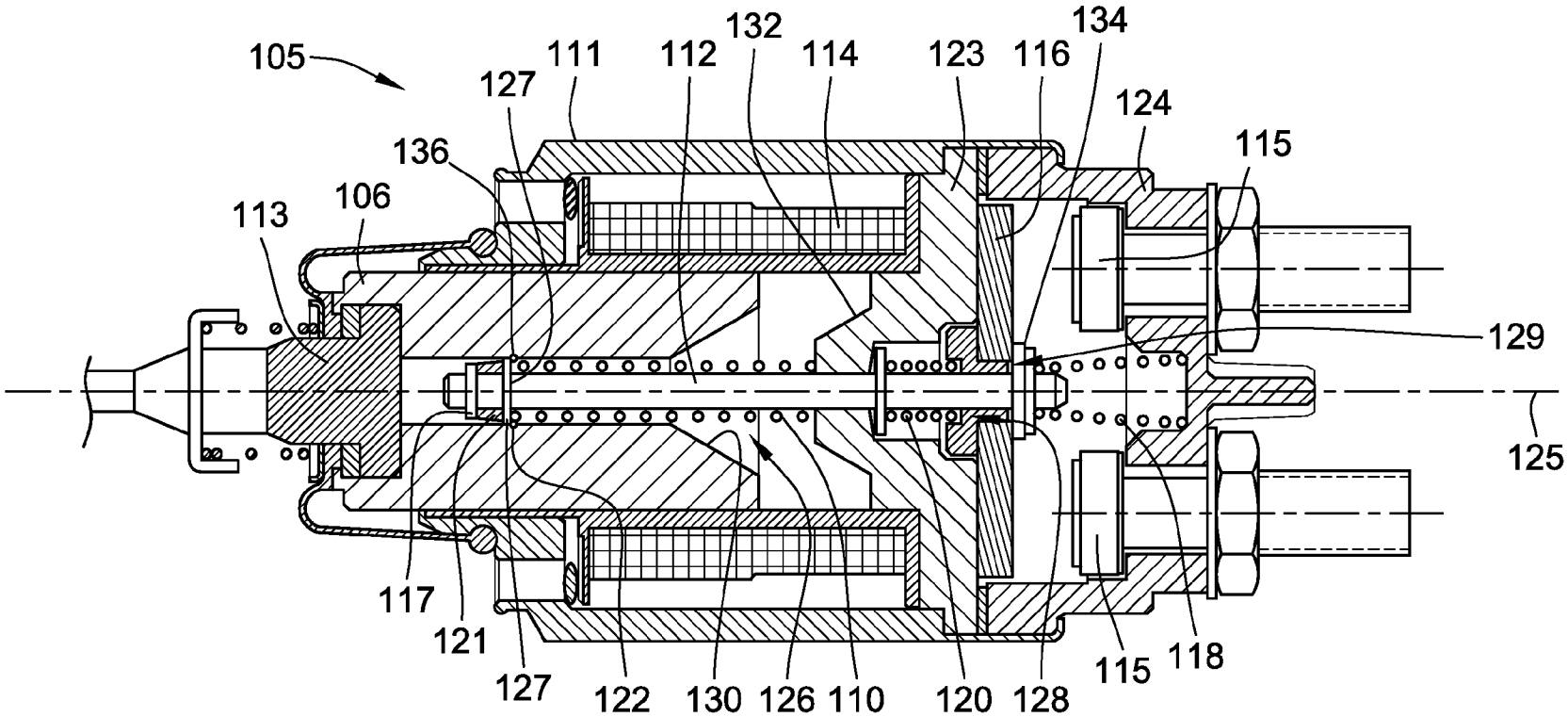
FIG. 2 is a cross-sectional view of the forced return solenoid assembly shown in FIG. 1.

FIG. 2 is a cross-sectional view of the forced return solenoid assembly 105 shown in FIGS. 1A and 1B. The forced return solenoid assembly 105 includes a housing 111, which is also the carrying body of the forced return solenoid assembly 105. Within the housing 111 of the solenoid assembly 105 there is the solenoid coil, also known as the pull-in and hold-in winding 114. The plunger 106 has a plunger handle 113 whose reciprocal movement, in turn, moves the slipping clutch and pinion 103 (shown in FIG. 1A) via the engagement lever 107 (shown in FIG. 1A). The plunger 106 is free to move axially within the cylindrical space inside the pull-in and hold-in winding 114.

In an embodiment of the invention, a cylindrical rod 112 is disposed in a central opening 126 within the plunger 106. The cylindrical rod 112 has a longitudinal axis that coincides with a longitudinal axis 125 of the solenoid assembly 105. A side plate 123, disposed within the housing 111, and abuts an electrical contact plate 116. The side plate 123 has a central opening 128 to accommodate the cylindrical rod 112. The electrical contact plate 116 has an opening 129 to accommodate the cylindrical rod 112, and abuts a flange 134 on the cylindrical rod 112. In an alternate embodiment, the flange 134 is a lock washer, nut or similar device attached to the cylindrical rod 112. As will be shown below, the presence of the attached flange 134 allows for compression of a second coil spring 118, when the plunger 106 moves toward the electrical terminals 115.

When the pull-in and hold-in winding 114 is not energized, the side plate 123 is normally separated from the plunger 106. In this embodiment, a first coil spring 110 is assembled onto the cylindrical rod 112 between the plunger 106 and the side plate 123. In at least one embodiment of the invention, the first coil spring 110 extends from a stopping ring 121, affixed to the cylindrical rod 112, to the side plate 123. The second coil spring 118 is positioned at one end of the cylindrical rod 112 between the cylindrical rod 112 and the terminal cover 124 at the end of the housing 111 that holds the electrical terminals 115. One end of the second coil spring 118 abuts the flange 134 on the cylindrical rod 112. The terminal cover 124 is configured to protect the contact and terminal area against the ingress of water and solid impurities that might degrade the performance of the solenoid assembly 105. A third coil spring 120 is positioned along the cylindrical rod 112 and acts as a contact reserve, and, as such, is configured to ensure good contact between the electrical contact plate 116 and the electrical terminal 115 in case of shifting tolerances related to the assembly process, or in case of contact wear. In contrast, the first coil spring 110 is configured to separate, or bias, the plunger 106 away from the side plate 123, and the second coil spring 118 is configured to separate, or bias, the electrical contact plate 116 and the cylindrical rod 112 away from the electrical terminals 115.

Figure 3:
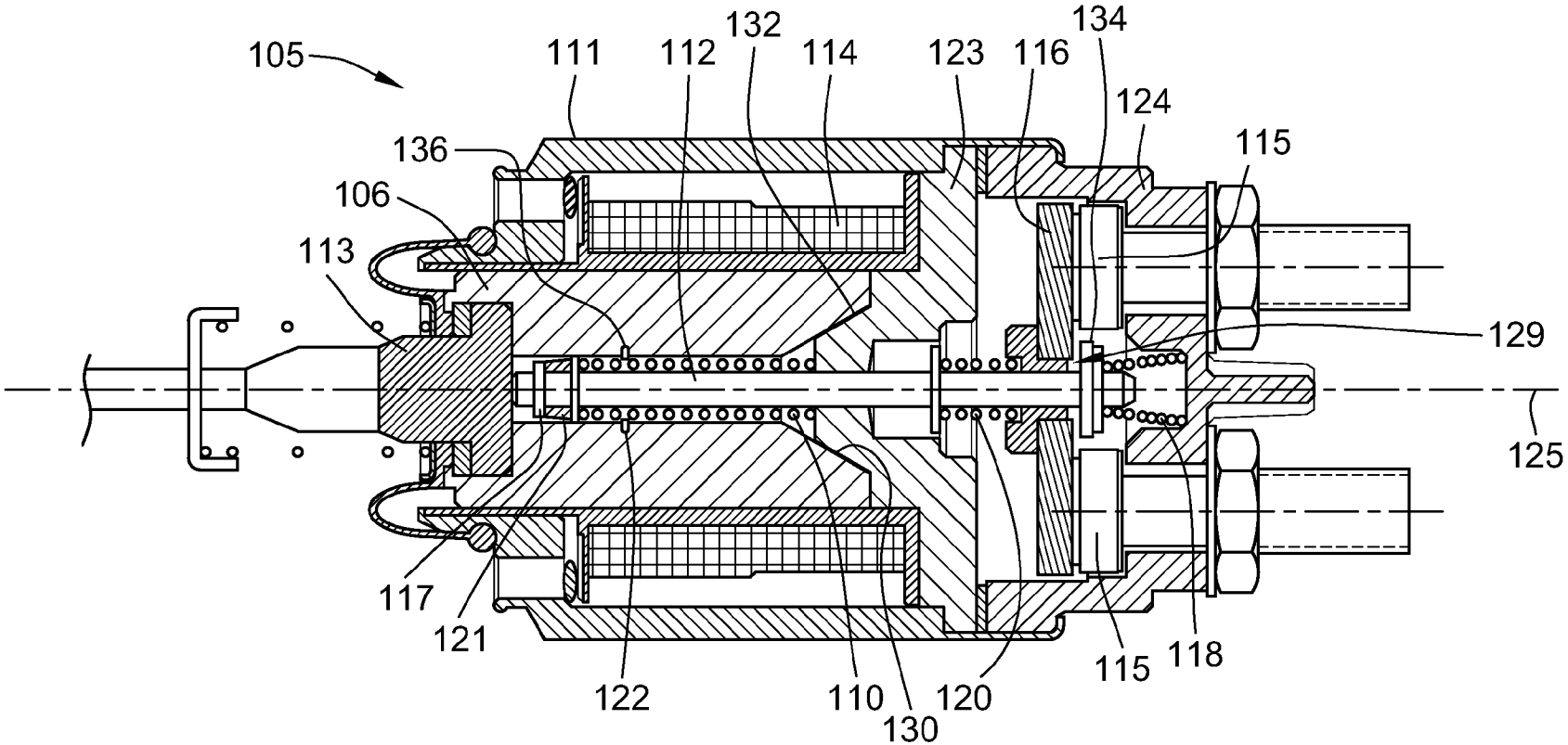
FIG. 3 is a cross-sectional view of the forced return solenoid assembly shown in FIG. 2, showing the movement of the plunger and contact plate after the solenoid winding has been energized.

FIG. 3 illustrates a cross-sectional view of the forced return solenoid assembly 105 showing the movement of the plunger 106 and electrical contact plate 116 after the pull-in and hold-in winding 114 has been energized. In operation, the forced return solenoid assembly 105 is energized by electrical current supplied to the pull-in and hold-in winding 114. The plunger 106 is made of a ferromagnetic material such that the electromagnetic forces generated by the pull-in and hold-in winding 114 will cause the plunger 106 to move axially within the winding 114. Referring to FIG. 1B, energizing the pull-in and hold-in winding 114 moves the plunger 106 to the right. As a result, the engagement lever 107 moves to the left bringing the slipping clutch and pinion 103 into contact with the engine's ring gear 109 (shown in FIG. 1B). As shown in FIG. 2, when the plunger 106 moves to the right, it compresses the first coil spring 110, the second coil spring 118, and the third coil spring 120. The electromagnetic forces generated by the pull-in and hold-in winding 114 must be stronger than the opposing force of the first coil spring 110, second coil spring 118, and third coil spring 120 to bring the plunger 106 into contact with the side plate 123. In at least one embodiment, the opening 126 (shown in FIG. 2) in the plunger 106 includes an angled portion 130 configured to align with an angled portion 132 of the side plate 123.

If the electromagnetic forces generated by the pull-in and hold-in winding 114 are sufficient, the plunger 106 will cause the cylindrical rod 112 and electrical contact plate 116 to move to the right, compressing the first coil spring 110. At the same time, the movement of the cylindrical rod 112 and the attached flange 134 toward the electrical terminals 115 compresses the second coil spring 118. Eventually, the movement of the plunger 106 brings the electrical contact plate 116 into contact with the electrical terminals 115. When the slipping clutch and pinion 103 (shown in FIG. 1B) is in contact with the engine's ring gear 109 (shown in FIG. 1B), the electrical contact plate 116 is also in contact with the electrical terminals 115. The electrical current flows to the DC electric motor 101 (shown in FIG. 1A), which causes the motor 101 to rotate. As a result, the torque from the rotating DC electric motor 101 is transmitted to the internal combustion engine (not shown).

When the vehicle operator releases the ignition key, the pull-in and hold-in winding 114 is no longer energized and, consequently, there is no electromagnetic force to hold the plunger 106 in contact with the side plate 123 of the forced return solenoid assembly 105. As a result, only the forces generated by the first and second coil springs 110, 118 act on the plunger 106 and electrical contact plate 116 via the cylindrical rod 112, and, under normal circumstances, cause the plunger 106 and electrical contact plate 116 to move back to their initial position before the pull-in and hold-in winding 114 was energized. Normally, the movement of the plunger 106 back to its initial position moves the engagement lever 107 causing the slipping clutch and pinion 103 to disengage from the engine's ring gear 109 (shown in FIG. 1A), and, at the same time, breaks the connection between the electrical contact plate 116 and the electrical terminals 115.

Figure 4:
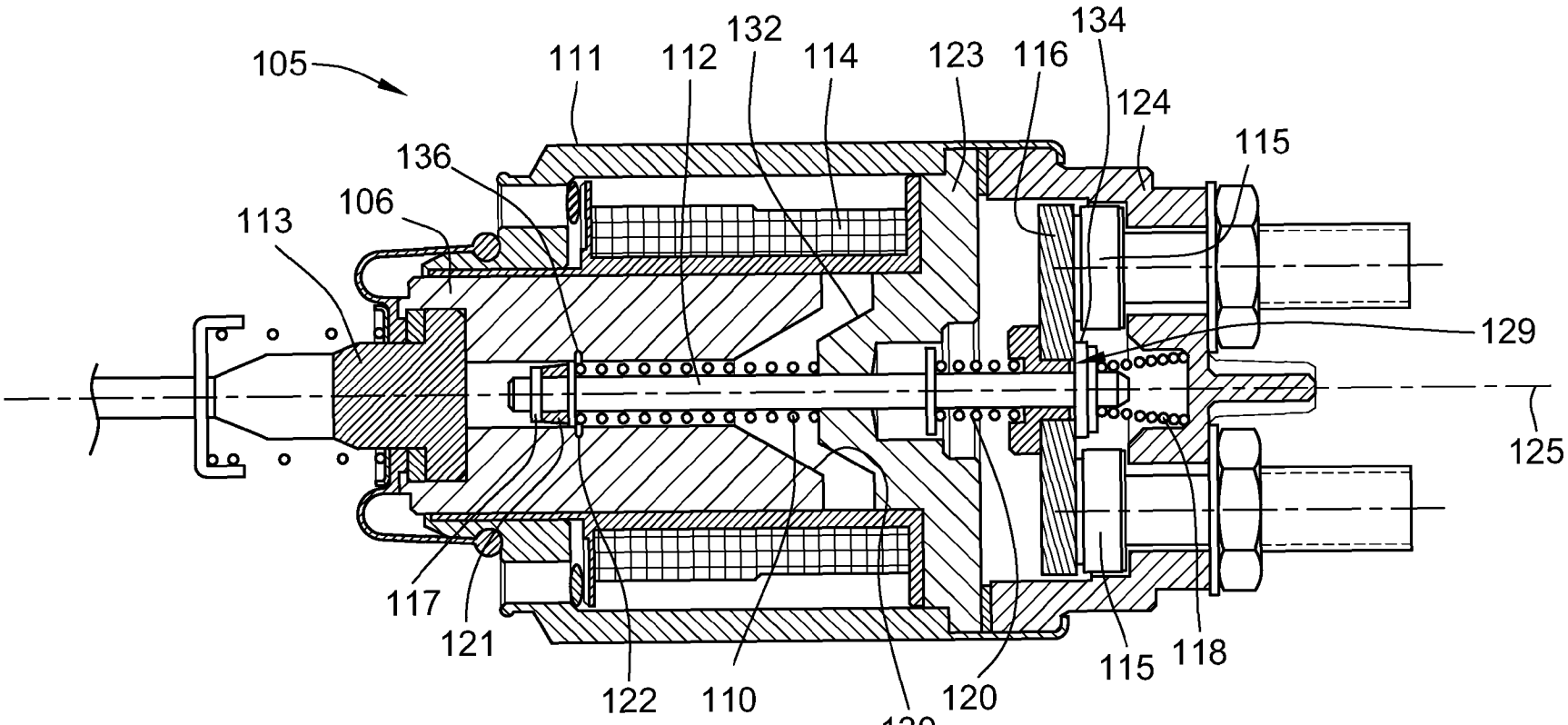
FIG. 4 is a cross-sectional view of the forced return solenoid assembly shown in FIG. 2 showing the electric contact plate partially fused to the electrical terminals.

However, in some cases, electrical arcing between the electrical contact plate 116 and the electrical terminals 115 may result in localized spots of molten metal at the site of the arcing. This, in turn, may cause the contact plate 116 to partially fuse with the electrical terminals 115. FIG. 4 provides a cross-sectional view of the forced return solenoid assembly 105 showing the electric contact plate partially fused to the electrical terminals. In such a case, the force of the second coil spring 118 may not be sufficient to separate the electrical contact plate 116 from the electrical terminals 115.

To address this problem, the plunger 106 includes a groove 136 into which a snap ring 122 is inserted. The snap ring 122 is configured such that its inner diameter protrudes into the opening 126 (shown in FIG. 2) in the plunger 106. As can be seen in the illustration of FIG. 2, the cylindrical rod 112 has the stopping ring 121 attached near an end of the cylindrical rod 112. In an embodiment of the invention, a first lock washer 117 is used to retain the stopping ring 121 from sliding off the end of the cylindrical rod 112. A second lock washer 127 on the other side (opposite the first lock washer 117) of the stopping ring 121 is used to keep the stopping ring 121 from sliding further down the cylindrical rod 112. The outer diameter of the stopping ring 121 is only slightly smaller than the diameter of the opening 126 in the plunger 106, such that axial movement of the plunger 106 in response to electromagnetic forces within the pull-in and hold-in winding 114 is not hindered by the stopping ring 121. In the embodiment shown in FIG. 2, there is only a small amount of clearance between the plunger 106 and the stopping ring 121. However, the outer diameter of the stopping ring 121 is larger than the inner diameter of the snap ring 122.

As can be seen in FIG. 2, the forced return solenoid assembly 105 is assembled such that the stopping ring 121 is to the left of the plunger groove 136 and snap ring 122. As such, the plunger 106 and snap ring 122 can move to the right towards the side plate 123 without the snap ring 122 impacting any part of the assembly. In those cases where the plunger 106 moves the cylindrical rod 112 and electrical contact plate 116 to the right until the electrical contact plate 116 contact the electrical terminals 115, and electrical arcing causes the electrical contact plate 116 and electrical terminals 115 to become partially fused in the manner described above, the contact plate 116 and cylindrical rod 112 will remain to the right of their initial position, even after the pull-in and hold-in winding 114 is de-energized and the plunger 106 starts to move to the left back to its initial position.

Referring again to FIG. 4, if the force from the second coil spring 118 is insufficient to separate the electrical contact plate 116 and electrical terminals 115, the force of the first coil spring 110 will still cause the plunger 106 to move to the left. As the spring force accelerates the plunger 106 to the left, at some point the snap ring 122 in the plunger 106 impacts the stopping ring 121 on the cylindrical rod 112 with enough force to separate the electrical contact plate 116 and electrical terminals 115. The kinetic energy from moving plunger 106 is transferred via the snap ring 122 to the stopping ring 121, cylindrical rod 112, and electrical contact plate 116, thus breaking the partial weld. In this manner, the combination of the snap ring 122 in plunger groove 136 and the stopping ring 121 attached to the cylindrical rod 112 provides a mechanism to break the partial fusing of the electrical contact plate 116 and electrical terminals 115.

An additional effect of the impact of the snap ring 122 and stopping ring 121 is that the force of the first coil spring 110 is added to the second coil spring 118. At that moment, there are at least three forces that are working to release or break the welded contact: the force of the first coil spring 110, the force of the second coil spring 118, and the kinetic energy from the plunger 106. Further, if the engine starts, there is an additional force working to break the weld. That force is supplied through the helix spline 138. In an embodiment of the invention, the helix spline 138 is coupled to one end of a drive assembly 140. The other end of the drive assembly is coupled to the slipping clutch and pinion 103. The force of the rotating slipping clutch and pinion 103 is transferred through the helix spline 138 to the electrical contact plate 116 via the plunger 106. When the engine is rotating faster than the starter motor 101 (shown in FIG. 1), the drive assembly 140 and helix spline 138 are configured to move to the right and out of contact with the ring gear 109. The movement of the drive assembly 140 and helix spline 138 to the right causes the engagement lever 107 to move the plunger 106 to the left, thus adding kinetic energy in a manner that would tend to separate an electrical contact plate 116 welded to electrical terminals 115. This additional force delivered to the plunger 106 through the helix spline 138 only occurs when the engine has been successfully started.

If the electrical contact plate 116 is welded to the electrical terminals 115, and the engine does not start, the slipping clutch and pinion 103 will oscillate back and forth due to the varying rotational speeds of the engine as it attempts to start. Because of the oscillating speed of the slipping clutch and pinion 103, there is also oscillating of the force, and it appears as slight impacting on the electrical contact plate 116 via a force placed on the plunger 106 by the pivoting engagement lever 107.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A forced return solenoid comprising:

an electrical winding configured to create an electromagnetic field when electrical current flows through the winding;

an electrical terminal configured to be connected to a source of electrical energy;

a moveable contact plate configured to be moved into contact with the electrical terminal;

a plunger configured to move axially in response to the electromagnetic field generated by the electrical winding, wherein movement of the plunger in a first direction causes the moveable contact plate to connect with the electrical terminal, and movement of the plunger in a second direction causes an impact intended to break the connection between the moveable contact plate and the electrical terminal; and a return spring configured to move the plunger in the second direction;

wherein the impact is via a removable snap ring affixed to the plunger.

2. The forced return solenoid of claim 1, further comprising a cylindrical rod configured to slideably engage the plunger, and to slideably engage the moveable contact plate via a side plate attached to the moveable contact plate.

3. The forced return solenoid of claim 2, wherein the cylindrical rod includes a stopping ring affixed near an end of the cylindrical rod, wherein the stopping ring is configured to be impacted by the snap ring.

4. The forced return solenoid of claim 2, further comprising a coil spring assembled onto the cylindrical rod between the plunger and the moveable contact plate.

5. The forced return solenoid of claim 2, wherein the moveable contact plate abuts the side plate when the solenoid is not energized, and wherein the side plate is configured to abut the plunger.

6. The forced return solenoid of claim 5, wherein the side plate and the plunger each have angled, mating surfaces where the abutment of the side plate and plunger takes place.

7. The forced return solenoid of claim 1, further comprising a coil spring disposed between the moveable contact plate and the electrical terminal.

8. The forced return solenoid of claim 1, further comprising a pivoting engagement lever coupled, at a first end, to an end portion of the moveable plunger, and, at a second end, to a helix spline, which is coupled to a drive assembly.

9. The forced return solenoid of claim 8, wherein the helix spline is configured to provide kinetic energy to the plunger via the engagement lever.

10. A method of operating a solenoid assembly used in a vehicle starting system, the method comprising the steps of:

mechanically biasing a moveable contact plate away from an electrical terminal such that the moveable contact plate and electrical terminal are physically separated;

mechanically biasing a moveable plunger away from the moveable contact plate such that the moveable plunger and the moveable contact plate are physically separated;

generating an electromagnetic field configured to overcome the bias on the moveable contact plate and the bias on the moveable plunger in order to bring the moveable contact plate into contact with the electrical terminal; and attaching a removable snap ring to the moveable plunger, the removable snap ring configured to transfer kinetic energy from the moveable plunger to the moveable contact plate.

11. The method of claim 10, wherein mechanically biasing a moveable plunger away from the moveable contact plate comprises positioning a first coil spring between the moveable plunger and the moveable contact plate, such that the first coil spring is assembled onto a cylindrical rod that slideably engages the moveable contact plate and the electrical terminal.

12. The method of claim 11, wherein mechanically biasing a moveable contact plate away from an electrical terminal comprises positioning a second coil spring between the moveable contact plate and the electrical terminal, such that an end of the second coil spring abuts the cylindrical rod.

13. The method of claim 11, further comprising assembling a stopping ring onto an end of the cylindrical rod furthest from the electrical terminal, the stopping ring configured to be impacted by the snap ring when the moveable plunger is moving under the force of the first coil spring.

14. The method of claim 10, wherein generating an electromagnetic field comprises providing an electrical winding that surrounds at least a portion of the moveable plunger.

15. The method of claim 10, further comprising configuring the moveable contact plate to abut a side plate that is configured to abut the plunger.

16. The method of claim 15, further comprising configuring the side plate and the plunger such that each have angled, mating surfaces where the abutment of the side plate and plunger takes place.

17. The method of claim 10 further comprising:

coupling a first end of a pivoting engagement lever to an end portion of the moveable plunger; and coupling a second end of the pivoting engagement lever to a drive assembly.

18. The method of claim 17, wherein coupling a second end of the pivoting engagement lever to a helix spline comprises coupling a second end of the pivoting engagement lever to a helix spline that is configured to provide kinetic energy to the plunger via the engagement lever.

* * * * *